United States Patent [19]

Walsh

[11] 4,409,512

[45] Oct. 11, 1983

[54] INCANDESCENT ELECTRIC LAMP WITH ETALON TYPE TRANSPARENT HEAT MIRROR

[75] Inventor: Peter Walsh, Stirling, N.J.

[73] Assignee: Duro-Test Corporation, North Bergen, N.J.

[21] Appl. No.: 291,941

[22] Filed: Aug. 11, 1981

Related U.S. Application Data

[63] Continuation of Ser. No. 45,645, Jun. 5, 1979, which is a continuation of Ser. No. 863,155, Dec. 22, 1977, abandoned.

[51] Int. Cl.[3] ..... H01J 5/16; H01J 61/40; H01K 1/26; H01K 1/30

[52] U.S. Cl. ..... 313/113; 313/37

[58] Field of Search ..... 313/113, 371, 112, 114

[56] References Cited

U.S. PATENT DOCUMENTS

| | | | |
|---|---|---|---|
| 3,188,513 | 6/1965 | Hansler | 313/112 |
| 3,682,528 | 8/1972 | Apfel et al. | 350/1.7 |
| 3,719,901 | 3/1973 | Monchamp et al. | 252/301.4 R |
| 3,846,152 | 11/1974 | Franz | 350/1.7 |
| 4,017,758 | 4/1977 | Almer et al. | 313/112 |

*Primary Examiner*—Alfred E. Smith
*Assistant Examiner*—K. Wieder
*Attorney, Agent, or Firm*—Darby & Darby

[57] ABSTRACT

An incandescent lamp utilizing an etalon type transparent heat mirror on the lamp envelope for transmitting radiation in the visible range produced by the lamp filament and reflecting infrared thermal radiation back to the filament for increasing its temperature and thereby increasing its efficiency.

14 Claims, 6 Drawing Figures

INCANDESCENT ELECTRIC LAMP WITH ETALON TYPE TRANSPARENT HEAT MIRROR

This application is a continuation of my prior copending application Ser. No. 045,645 filed June 5, 1979, which in turn is a continuation of my prior then copending application Ser. No. 863,155, filed Dec. 22, 1977, now abandoned, both of which applications are assigned to the same assignee.

In the copending application of Peter J. Walsh, Wolfgang Thouret and Ronald Koo, Ser. No. 781,355, filed Mar. 25, 1977, and assigned to the assignee of the subject application, novel incandescent electric lamps are disclosed which utilize transparent heat mirrors. Such mirrors comprise a coating which has the ability to reflect infrared energy while transmitting energy in the visible range. The coatings of the aforesaid application are of a type which have a discrete metallic film sandwiched between two dielectric films. In the preferred embodiment of coating in the aforesaid application, the dielectric films are formed of titanium dioxide and the metal film of silver. Coatings of the general type, i.e., $TiO_2/Ag/TiO_2$, for use in solar heaters are disclosed in an article entitled "Transparent Mirrors for Solar-Energy Applications" by John C. C. Fan and Frank J. Bachner in Applied Optics, Volume 15, No. 4, April 1976, pages 1012–1017.

The transparent heat mirror coatings of the aforesaid application are utilized in a unique manner on the wall of the lamp glass envelope for the purpose of transmitting the visible light produced by the incandescent filament and reflecting the infrared energy produced by such filament. The envelope is shaped so as to reflect infrared (IR) radiation back to the filament to thereby raise its temperature. The end result of this is that the filament is at least partially heated by the reflected IR energy thereby resulting in a reduction in the amount of electrical energy needed to heat the filament. This results in an energy-saving lamp.

A $TiO_2/Ag/TiO_2$ coating as applied to an incandescent lamp has several novel features and advantages. First of all, silver is unique among the common non-alkaline metals in having the lowest absorption to visible light and infrared radiation. A thin film of silver can be considered an almost lossless material to visible light. The use of the two layers of dielectric material, e.g., $TiO_2$, improves the visible transmission. Theoretically, a three-film insulator-silver-insulator (ISI) coating, can be designed to maximize the transmission of visible energy wavelength at the peak of the luminous output of an incandescent lamp (about 585 nm for a 3,000° K. tungsten filament). This requirement uniquely determines the optimum thickness of the silver and insulator films for any given insulator material. For a $TiO_2/Ag/TiO_2$ film these are approximately 325 A°/240 A°/325 A° for the aforesaid incandescent lamp.

Since silver becomes more reflective in the infrared region of the spectrum, the infrared reflectivity of the ISI coating increases at a rate determined by the silver thickness and cannot be further adjusted. Other insulator materials besides $TiO_2$ can be used and the silver thickness and insulator thickness are different. Several of these are disclosed in the aforesaid patent application. However, it appears that $TiO_2$ with its high refractive index is an optimum insulator material for silver in an ISI coating. It should also be understood, as described by the Fan-Bachner article, that of the common metals, silver is the best for transmitting visible light, that is, it is the least absorptive. Gold, aluminum and copper are somewhat more absorptive.

One of the disadvantages of the $TiO_2/Ag/TiO_2$ combination is that the reflectivity of the energy in the near infrared region is not as high as optimally desired for certain applications, for example, in an incandescent electric lamp. In addition, $TiO_2$ is a fairly refractory substance and where it is deposited on a substrate by sputtering, it sputters slowly in film preparation (the sputtering rate of $TiO_2$ is only about 3–5% of that of Ag). The latter disadvantage makes the time of production relatively lengthy and, consequently, results in increased cost.

Accordingly, it would be desirable to have a coating which uses silver with another less refractory insulator material and which will produce a higher IR reflectivity than the $TiO_2/Ag/TiO_2$ coating while approaching the ideal of one hundred percent transmittance to visible energy, neglecting the absorption of the metal itself.

The foregoing advantages are accomplished in accordance with the subject invention by providing an incandescent lamp utilizing a multi-film coating designed following some of the teachings of the etalon principle. An etalon device utilizes a layer of insulating material, for example air, between two metal reflective layers, for example, silver. In conventional etalon devices, the thickness of the layer of insulating material is chosen to produce a 180° phase shift of energy of a certain wavelength passing through it in a two-way trip, that is, travelling from the source through the insulator and being reflected by the metal film remote from the source back toward the source. A device utilizing the etalon effect includes the Fabrey-interferometer. So-called interference filters also have been disclosed utilizing this effect, one such filter shown in U.S. Pat. No. 3,682,528 to Apfel et al, granted Aug. 8, 1972, in which the etalon coating is sandwiched between two pieces of glass.

The present invention applies an etalon type device to an incandescent lamp in that a composite metal-insulator-metal coating of thin films is formed on the wall of an incandescent lamp envelope. The thickness of the individual films of the coating and their inter-relationship are selected so as to maximize the coating transmission characteristics to energy produced by the filament in the visible range and also to maximize the reflecting properties to energy in the infrared range.

It is therefore an object of the present invention to provide an incandescent electric lamp utilizing a transparent etalon type heat mirror for transmitting visible energy produced by the filament while reflecting infrared energy back toward the filament.

An additional object is to provide an incandescent electric lamp utilizing an etalon type heat mirror designed to transmit visible light and to reflect IR energy back towards the filament to raise its temperature and thereby increase its efficiency.

Other objects and advantages of the present invention will become more apparent upon reference to the following specification and annexed drawings in which.

Figure 1:
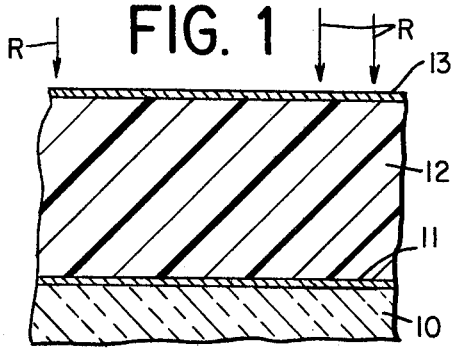
FIG. 1 is a side elevational view in section showing a heat-transparent mirror utilizing an etalon film in accordance with the present invention.

FIG. 1 shows a fragment of a substrate 10, for example, of lime glass or Pyrex, on which the etalon coating is deposited. The etalon coating has three discrete film components. The first of these is a film layer 11 of a reflecting metal, such as silver, which is deposited on one surface of the substrate 10, a film layer of an insulating material 12 (to be discussed in detail below) which is deposited on the metal film layer 11, and an outer film layer 13 of a reflecting metal, which also can be silver, which is deposited on the insulator. Any conventional and suitable techniques can be used for depositing the three layers, some of these being, for example, chemical deposition, vapor deposition, sputtering, etc. The three film layers are preferably made separate and discrete from each other. That is, it is preferred that there be no inter-diffusion of the layer materials. However, the film layers cooperate to produce the desired transmission and reflection characteristics and they are designed as a composite.

Incident radiation R, assumed to have components in the visible spectrum as well as a component in the infrared spectrum, is shown as impinging upon the layer 13 most remote from substrate 10. In accordance with the invention, the etalon coating is designed to have characteristics such that it will transmit a maximum amount of energy in the visible wavelength range and will reflect a maximum amount of energy in the longer wavelength range, including the IR band.

Figure 2:
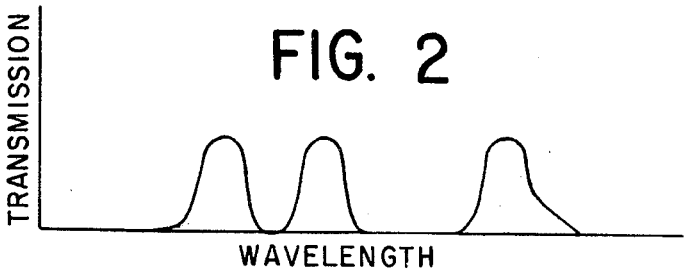
FIG. 2 is a diagram illustrating the general response of an etalon film.

FIG. 2 shows a typical response curve for an etalon coating. The ordinate shows the transmission characteristic of the coating to incident radiation and the abscissa shows the wavelength. Characteristically, there are a number of energy transmission passbands at different wavelengths, these wavelengths being integrally multiply related. The elaton coating has a last transmission passband at the longest wavelength, this shown as the third from the right. The number of transmission passbands depends upon the coating design. In the present invention, the coating is designed to use the last passband to transmit visible energy and to block, or reflect, IR energy. Also, the etalon is designed so that, the last transmission peak of FIG. 2 (located at largest wavelength), falls at the peak of the luminous output of the filament used for the lamp.

In the design of the etalon-type coatings, the nature of the insulating film layer, that is, its index of refraction and thickness, controls the width and shape of the passband characteristic and, in conjunction with the metal layers, the slope of the passband cutoff, that is, the sharpness at which the mirror makes the transition from transparent to reflective at the desired wavelength. The metal layers provide the IR energy reflectance. An optimum design, insofar as an incandescent electric lamp is concerned, has a high transmission in the visible range with little absorption and a high reflectance in the IR range. The design of the optimum filter balances several considerations. A small amount of visible absorption requires a thin metal film while high IR reflection requires a thick metal film. In addition, the location of the transmission peak in the visible range and a rapid rise in reflection as the IR is approached demands that the dielectric film 12, in thickness and index, must be properly designed in conjunction with the metal films 11,13.

It should be understood that conventional quarter wave theory can not be used in the design of an etalon operating as disclosed in the subject invention. Conventional quarter wave theory considers phase changes induced by the metallic film as those due to a very thick film. For example, the phase change upon reflection from one metal layer of the etalon is taken in conventional quarter wave theory as $-180°$. In the thin metal films used in this invention, reflection and transmission phase changes depart completely from conventional quarter wave practice and design according to that practice give composite filters which are far inferior to the filters of this invention. The rapid rise in IR reflectivity displayed by the filters employed here cannot be predicted by conventional quarter wave theory. In addition, conventional quarter wave theory demands a thickness of the dielectric layer which can, when employed in practice, place the peak in light transmission far away from the portion of the visible wavelength region desired.

Figure 3:
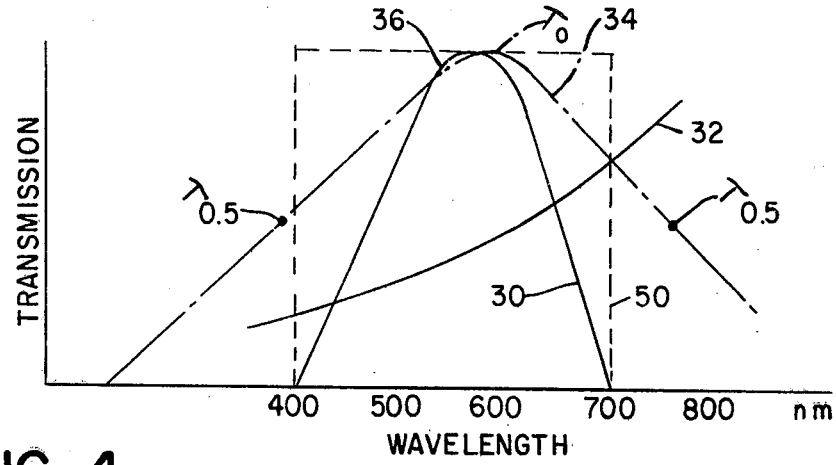
FIG. 3 is a schematic diagram showing the response characteristic of a preferred etalon film utilizable with an electric lamp and the overlay of the response curves of the eye and a typical incandescent filament.

FIG. 3 shows a graphical representation of certain criteria for the design of an efficient etalon-type filter for an incandescent lamp. Curve 30 shows the response of the eye, generally from about 400–700 nm, with a peak at about 550 nm, in the yellow color range. Curve 32 represents the output of an incandescent tungsten filament. As the tungsten filament is heated to a higher temperature, the curve 32 would shift upward and further to the left. At all practical operating temperatures, the tungsten filament produces a preponderant amount of IR energy.

Dotted line curve 50 represents an idealized transmission bandpass curve for the transparent heat mirror as applied to an incandescent lamp. That is, an idealized coating will transmit all visible energy from 400 to 700 nm and reflect all other energy, particularly all IR energy above 700 nm. Such a curve as 50 with a vertical cutoff line is not practically realizable. The dash-dot line curve 34 represents the desirable bandpass transmission characteristic of a coating, which is obtainable with an etalon type coating. As explained previously, the thickness of the metal layers controls the width of curve 34 and the thickness of the dielectric film, in cooperation with the metal films, the wavelength of its peak. On curve 34, $\lambda_0$ represents the wavelength at which maximum possible energy is transmitted and the two points designated $\lambda_{0.5}$ on each side of the curve each represent the point at which one-half of the peak of the visible energy is transmitted.

Figure 4:
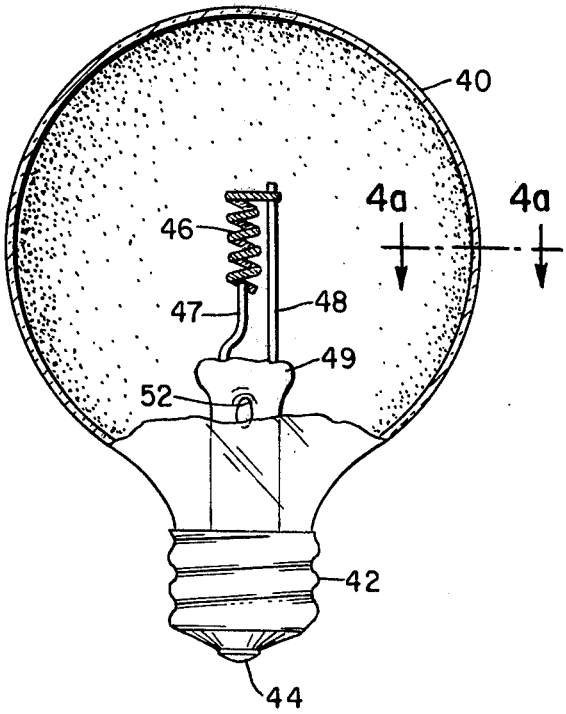
FIG. 4 is a view of an electric lamp made in accordance with the invention.
Figure 4A:
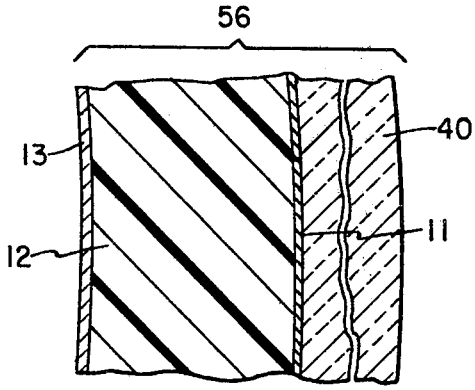
FIG. 4A is an enlarged fragmentary view of a portion of the lamp envelope and the coating.

FIG. 4 shows an incandescent lamp in accordance with the invention, a fragment of the lamp being shown enlarged in FIG. 4A to show the details of the transparent mirror coating. The lamp includes a glass envelope 40 of a conventional PYREX, lime grass, or other suitable refractory material. A metal base 42 is provided at the bottom of the envelope for sealing it. The base also has a lower button contact 44 to provide, with base 42, the electrical current to a filament 46 mounted on electrically conductive leads 47,48, the leads extend through a stem 49 of insulating material, such as glass, which contains an exhaust tubulation 52 through which the envelope is exhausted. The leads 47,48 are connected to the base and contact button.

Upon application of current to filament 46, it incandesces and produces radiant energy in both the visible and IR range, as shown in FIG. 3. Typical operating temperatures for the filament are in the range from about 2300° K. to about 3300° K. As the filament temperature decreases, the peak ($\lambda_0$) of the light output decreases in wavelength (becomes more reddish) and as the filament operating temperature increases, the wavelength of the light output increases (becomes more greenish).

A transparent heat mirror coating, generally designated as 56, is located on the inner wall of envelope 40. The purpose of coating 56 is to pass as much as the visible light as possible from filament 46 through envelope 40 and to reflect as much of the filament's IR energy as possible back toward and onto the filament. An ideal transparent heat mirror for an incandescent lamp would pass all energy within the visible range of the eye and reflect all IR energy. As explained below, the etalon is designed to approach or be at maximum transmission to visible energy at the wavelength $\lambda_0$ of maximum lumen (visible) output of the filament. This peak shifts by a relatively small amount over a fairly wide operating filament temperature range, for example, from about 550–590 nm over a temperature range of from about 3300° K. down to 2300° K. This range overlaps the wavelength of maximum eye sensitivity.

Filament 46 and envelope 40 are preferably designed to be optically related so that the maximum amount of IR energy produced by the filament 46 and incident on the inner wall of the envelope is reflected back toward the filament. One way of doing this is to select the interrelationship of the shape and design of both the filament and envelope. These relationships are explained in greater detail in the aforesaid application Ser. No. 781,355. However, a reduced energy consumption benefit can be obtained even if the filament is not optically centered.

The coating 56 is preferably placed on the inner wall of envelope 40 by any suitable and conventional technique, e.g., chemical or vapor deposition, RF sputtering, etc. Coating 56 also can be placed on the outer wall of the envelope, although this is less preferable since it would be more subject to abuse and damage.

Coating 56 is formed by the outer and inner metal film 11,13 which sandwiches the dielectric film 12. In the preferred embodiment, the metal films 11,13 are of silver since this metal, of the more common ones, has the highest transmission to visible light. Other metals (e.g. gold, copper, aluminum), alloys, and indeed two different metals, may be used as the metal layers of the sandwich. The insulator, or dielectric, film 12, can be any suitable insulating material which is compatible with silver. Preferred insulators are silver chloride (AgCl) and magnesium fluoride ($MgF_2$). Silver chloride has the advantage of being highly compatible with a silver metal film. The coating system is hereafter referred to as S-I-S (silver-insulator-silver) to distinguish it from I-S-I systems of the $TiO_2/Ag/TiO_2$ type.

The thickness of insulator 12 is chosen so that the phase angle due to two way travel in the insulator between the silver film 11,13 plus two reflections off the silver films, is 0° at the visible wavelength chosen for maximum transmission. In the visible region the phase angle due to reflection off the silver does not commonly follow quarter wave practice. The relative silver film thicknesses are chosen to give the same individual reflectivities. With this arrangement, constructive interference occurs and the overall transmission of the combination is 100% at the chosen visible wavelength as with the I-S-I combination, neglecting absorption in the silver film.

To find the thickness of the silver and dielectric films, the following steps are taken:

(1) First, the peak transmission is located at a chosen visible wavelength, $\lambda_0$, where the overall phase angle, $\delta$, is set to zero. The wavelength $\lambda_0$ is generally selected as the peak of the luminous output of the filament. For example, a filament operating at about 3000° K. has a peak at about 585 nm. Here $$\delta = Q_{12,GLASS} + Q_{12,AIR} + 2Q$$

$$Q = \frac{\rho\eta 2\pi}{\lambda}$$

$\rho$=insulator thickness.

$\eta$=insulator index of refraction at $\lambda$.

$Q_{ij}$=reflectivity phase change from insulator i,j film 12 to either metal film 11 on glass side or metal film 13 on air side.

This quantity is determined from the equation:

$$\tan Q_{i,j} = \frac{-\left(2\eta_i\left(K + \frac{\eta_j^2}{K}\right)\cosh\alpha_{ij}\sinh\alpha_{ij}\right]}{\left[(\eta_i^2 - \eta_j^2)\cosh\alpha_{i,j} - \left(K^2 - \frac{\eta_i^2\eta_j^2}{K^2}\right)\sinh^2\alpha_{i,j}\right]}$$

i=12, j=glass or air.

$\eta_i$=dielectric index of dielectric 12.

$\eta_j$=dielectric index of either glass or air.

K=imaginary part of complex refractive index of silver. Real part is taken as zero.

$$\alpha_{ij} = \frac{l_{ij}K2\pi}{\lambda}$$

$\rho_{ij}$=silver film thickness between dielectric 12 and either glass or air.

(2) Second, the wavelength at which the transmission falls to one-half its peak value is chosen at $\lambda_{0.5}$ (see FIG. 3) by setting $$\frac{4R_M}{(1 - R_M)^2}\sin^2\left(\frac{\delta_{0.5}}{2}\right) = 1$$

Here assume $R_M \cong R_{12}$, glass$\cong R_{12}$, Air where:

$$R_{i,j} = \frac{(\eta_i - \eta_j)^2\cosh^2\alpha_{ij} + \left(K + \frac{\eta_i\eta_j}{K}\right)^2\sinh^2\alpha_{ij}}{(\eta_i + \eta_j)^2\cosh^2\alpha_{ij} + \left(K - \frac{\eta_i\eta_j}{K}\right)^2\sinh^2\alpha_{ij}}$$

The quantity $\delta_{0.5}$ along with the $\alpha_{ij}$ and the indices $\eta_i$, $\eta_j$ and K are evaluated as before, but at the wavelength $\lambda_{0.5}$. The $\lambda_{0.5}$ dealt with is the higher one, since it is the action of the etalon coating in the wavelength region from visible to IR which is of particular interest. In an incandescent lamp according to the invention operating on the last etalon peak, $\lambda_{0.5}$ is typically set at about 800 nm. It is at the wavelength that the eye rapidly begins to lose visual response to the energy and the IR energy starts to become effective. By designing the high wavelength skirt wall of the bandpass transmission properly, the IR reflectivity can approach the range of about 90% or better at 1000 nm, where the IR energy is effective, and continue to increase with increasing wavelength.

These prescriptions determine the three variable quantities of the etalon film: two silver film thicknesses and the dielectric layer thickness, once the $\eta$'s and K are known as functions of wavelength. The method can be applied to any suitable metals, metal alloys or combinations of metals or metal alloys.

The reflectivity in the near IR increases rapidly with wavelength by a mechanism outside conventional quarter wave theory. At longer wavelengths of the infrared the phase difference in the insulator decreases toward zero, while the phase shift on each reflection decreases toward $-180°$, the conventional value taken in the quarter wave practice. At some near IR wavelength the overall phase angle decreases from 0° to $-180°$ (on its way to $-360°$ at very large wavelength) and destructive etalon interference occurs giving an overall reflectivity of $4R_M/(1+R_M)^2$. This overall reflectivity is very close to unity for $R_M>0.5$, where $R_M$ is the IR reflectivity of one silver film. Thus, a particular silver-insulator-silver combination can be designed to give a high IR reflectivity, say at a wavelength of 1 micron. As wavelength increases further, the reflectivity increases uniformly toward unity.

Films of many common insulators will produce higher IR reflectivities in the S-I-S coating than does $TiO_2$ in an I-S-I $TiO_2/Ag/TiO_2$ coating for the same overall thickness for the silver films, i.e., one film for I-S-I and two for S-I-S. Materials having lower indices of refraction, and less refractory materials are favored in the S-I-S coating, so that rapid sputtering, evaporation, vapor or chemical deposition may be possible for depositing the insulator film. In addition to the freedom in choosing an insulator, the overall thickness of the silver film can also be varied to produce a wider design range for the bandpass characteristics in the S-I-S combination than in any I-S-I combination since the I-S-I combination does not allow freedom in choosing prescription (3).

Table I below compares calculated values of transmission and reflection for two S-I-S coatings with a $TiO_2/Ag/TiO_2$ coating, all coatings designed for 100% nominal visible transmission at 600 nm.

In Table I the light absorption has been neglected. In a good silver film it will probably be less than 5% in the visible and less than 1–2% over most of the IR range. For comparison purposes, the overall silver thickness in the S-I-S coatings has been selected to be the same as in the coatings of prior application Ser. No. 781,355 so that the absorption of visible light in both coatings should be essentially identical. Thicker or thinner silver films can be used in S-I-S coatings. In $TiO_2/Ag/TiO_2$ coatings, the silver thickness is not readily adjustable.

TABLE I

| Ex.: | $TiO_2/Ag/TiO_2$ 325Å-240Å-325Å | Ex.: | $Ag/MgF_2/Ag$ 120Å-1770Å-120Å |
|---|---|---|---|
| designed for transmission to visible (T) = 100% at 600 nm | | | |

| | SYSTEM | IR Reflectivity 600 nm | 1,100 nm | 1,700 nm |
|---|---|---|---|---|
| I-S-I: | $TiO_2/Ag/TiO_2$ | 0% | 84% | 94.5% |
| S-I-S: | Ag/AgCl/Ag | 0% | 89% | 95% |
| S-I-S: | $Ag/MgF_2/Ag$ | 0% | 93% | 98% |

In all cases, the total Ag thickness is chosen so as to yield a similar absorption (5%, at 600 nm, for a good silver film). Further, in Table I, the ideal reflectivity is calculated at 3 wavelengths and absorption is neglected.

Variations of the above described S-I-S coating are possible over the visible band. In typical coatings, the silver film can be in the range of from about 105 Å to about 135 Å and the magnesium fluoride film in the range of from about 1605 Å to about 1935 Å.

Other readily available insulators which can be used with silver are aluminum oxide, titanium dioxide and chromium oxide. A typical coating of $Ag/TiO_2/Ag$ would have the two silver films each in the range of from about 105 Å to about 135 Å and the $TiO_2$ dielectric film in the range of from about 600 Å to about 830 Å with a preferred coating having silver films of about 120 Å and the dielectric film of about 720 Å.

For satisfactory S-I-S etalon coatings for an incandescent lamp, the etalon should be designed for maximum transmission at the peak of the luminous output of the filament. For conventional tungsten filaments operating in a conventional temperature range (e.g. 2300° K. to 3300° K.), the filament peak luminous output will be close to the point of maximum eye sensitivity. The $\lambda_{0.5}$ point is selected to pass the useful visible energy and to block the IR energy.

Figure 5:
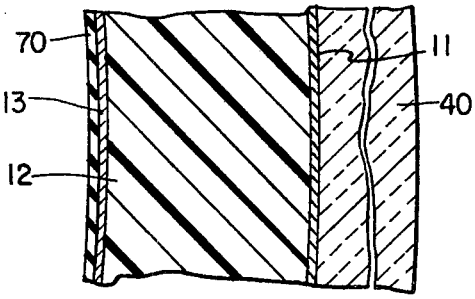
FIG. 5 is a diagram of an electric lamp made in accordance with the invention utilizing an additional coating for protection effect.

FIG. 5 shows a further embodiment of the invention wherein the coating on the interior of the lamp envelope has been overcoated with a film layer 70 on the face opposite the filament to protect the coating. The coating 70 should be compatible with the metal, here silver, and also protect the coating against deleterious materials, such as tungsten evaporated from the filament. Suitable coating materials are, for example, any of the dielectric materials previously mentioned as well as others, the principal criterion being that their absorption to light and near infrared be negligible.

Where a protective film such as 70 is used, in calculating the thickness of the S-I-S films, the protective film must be accounted for in designing the S-I-S coating.

As explained previously, the S-I-S film can be coated on the exterior of the envelope. Calculations can be made for the thicknesses of the film and the index of the dielectric in the manner described above, using appropriate optical coefficients. Comparing the arrangement with the coating on the exterior of the bulb previously described, the thicknesses of the films without overcoat would be the same as when coated on the inside of the bulb. For exterior S-I-S films, overcoats of a protective layer can include, for example, plastic and organic materials which are transmissive to visible light.

What is claimed is:

1. An incandescent electric lamp comprising a sealed envelope of a material which is transparent to light in the visible range, an incandescent filament within said envelope, means for supplying electrical current to said filament to cause it to incandesce at a temperature so as to produce light energy in at least a portion of the visible range and energy in the infrared range, the major portion of said envelope being optically shaped with a curved surface curved in at least two directions in any given area to reflect energy back toward and to impinge upon said filament, an etalon coating located directly on a substantial part of the curved surface portion of the envelope, said coating comprising only a single triad of films consisting of a film of a dielectric material sandwiched between and in direct contact with two films of an electrically conductive metal with one of said films of electrically conductive metal being deposited directly on the envelope, said films being matched to the characteristics of both the visible range light energy and the infrared range energy produced by the filament for transmitting exterior to the lamp at least about 80% of the visible range light energy at the peak of the luminosity curve of the visible range light energy produced by the filament and for reflecting at least about 75% of the energy in the infrared range at about 1.0 micron and above back towards the filament to impinge thereon to thereby increase the operating temperature of the filament and to reduce the amount of electrical current needed to heat said filament to incandescence.

2. An incandescent lamp as in claim 1 wherein both metal films comprise silver.

3. An incandescent lamp as in claim 1 wherein the metal films are selected from the group consisting of gold, silver and copper.

4. An incandescent lamp as in claim 1 wherein the dielectric material is selected from the group consisting of silver chloride, magnesium fluoride, aluminum oxide, titanium dioxide and magnesium oxide.

5. An incandescent lamp as in claim 1 wherein the etalon coating operates on the last passband characteristic and the peak of the passband is selected to be at a wavelength substantially corresponding to the wavelength of maximum luminosity output of visible range light energy produced by the filament.

6. An incandescent lamp as in claim 1 wherein the filament operates in a temperature range of from about 2300° K. to about 3300° K.

7. An incandescent lamp as in claim 6 wherein the wavelength at which the last passband of the etalon coating has substantially about one-half of the peak of the maximum luminosity output is in the transition region between the visible and infrared energy regions.

8. An incandescent lamp as in claim 7 wherein the wavelength of the half-energy point is at about 800 nm.

9. An incandescent lamp as in either of claims 5 or 6 wherein the metal films are silver and the dielectric material is of magnesium fluoride.

10. An incandescent lamp as in claim 9 wherein the silver films each have a thickness in the range of from about 105 Å to about 135 Å and the magnesium fluoride film a thickness in the range of from about 1605 Å to about 1935 Å.

11. An incandescent lamp as in claim 10 wherein the wavelength of peak transmittance of the coating is at about 585 nm, and the thicknesses of the silver films is each about 120 Å and that of the dielectric film about 1770 Å.

12. An incandescent lamp as in either of claims 5 or 6 wherein the metal films are each of silver and the dielectric material film of silver chloride.

13. An incandescent lamp as in either of claims 5 or 6 wherein the metal films are each of silver having a thickness in the range of from about 105 Å to about 135 Å and the dielectric material film is of titanium dioxide having a thickness in the range of from about 600 Å to about 830 Å.

14. An incandescent lamp as in claim 13 wherein the wavelength of peak transmittance of the coating is at about 585 nm, and the thickness of the silver films is each about 120 A and that of the dielectric film about 720 A.

* * * * *